United States Patent [19]

Szegda

[11] Patent Number: 5,073,129

[45] Date of Patent: Dec. 17, 1991

[54] COAXIAL CABLE END CONNECTOR

[75] Inventor: Andrew Szegda, Canastota, N.Y.

[73] Assignee: John Mezzalingua Assoc. Inc., Manlius, N.Y.

[21] Appl. No.: 647,837

[22] Filed: Jan. 30, 1991

Related U.S. Application Data

[62] Division of Ser. No. 364,303, Jun. 12, 1989, Pat. No. 4,490,106.

[51] Int. Cl.[5] ..... H01R 17/18

[52] U.S. Cl. ..... 439/585; 439/882

[58] Field of Search ..... 439/578–585, 439/675, 877–882

[56] References Cited

U.S. PATENT DOCUMENTS

| | | | |
|---|---|---|---|
| 3,355,698 | 11/1967 | Keller | 339/97 |
| 3,363,222 | 1/1968 | Karol | 339/221 |
| 4,400,050 | 8/1983 | Hayward | 339/177 R |
| 4,553,806 | 11/1985 | Forney et al. | 339/946 |
| 4,668,043 | 5/1987 | Saba et al. . | |
| 4,684,201 | 8/1987 | Hutter | 439/585 |
| 4,755,152 | 7/1988 | Elliot et al. | 439/452 |
| 4,806,116 | 2/1989 | Ackerman | 493/304 |

FOREIGN PATENT DOCUMENTS

| | | |
|---|---|---|
| 2406417 | 8/1974 | Fed. Rep. of Germany . |

*Primary Examiner*—David L. Pirlot

*Attorney, Agent, or Firm*—Samuels, Gauthier & Stevens

[57] ABSTRACT

An end connector is disclosed for cables, particularly coaxial cables of the type employed in the cable television industry. The crimping sleeve of the connector has external ribs and internal serrations designed to accommodate a wide range of cable sizes in a manner which insures a reliable electrical connection, a secure mechanical coupling, and a weather tight seal.

14 Claims, 3 Drawing Sheets

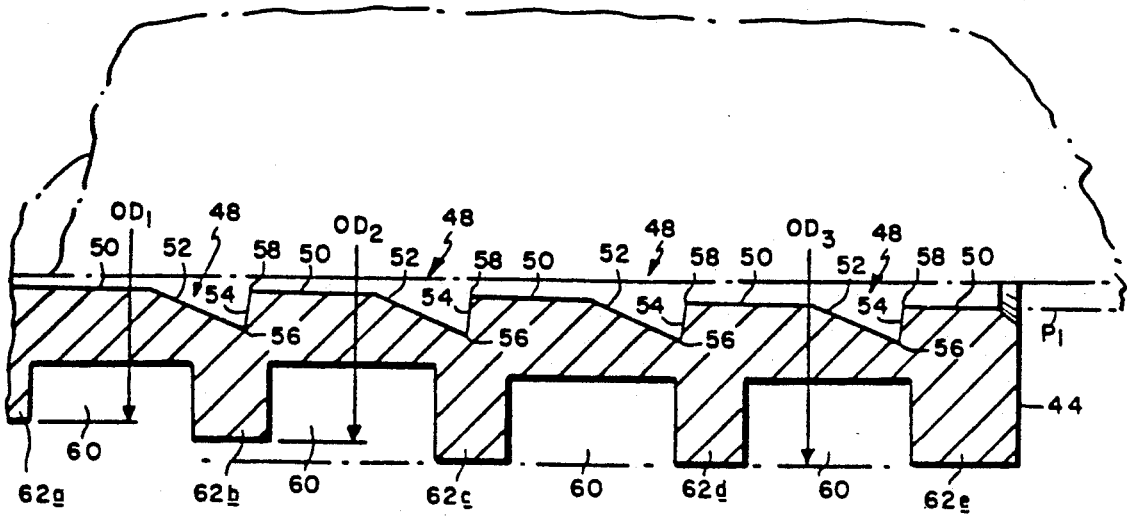
FIG.4
FIG.5
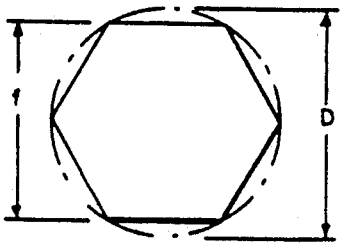
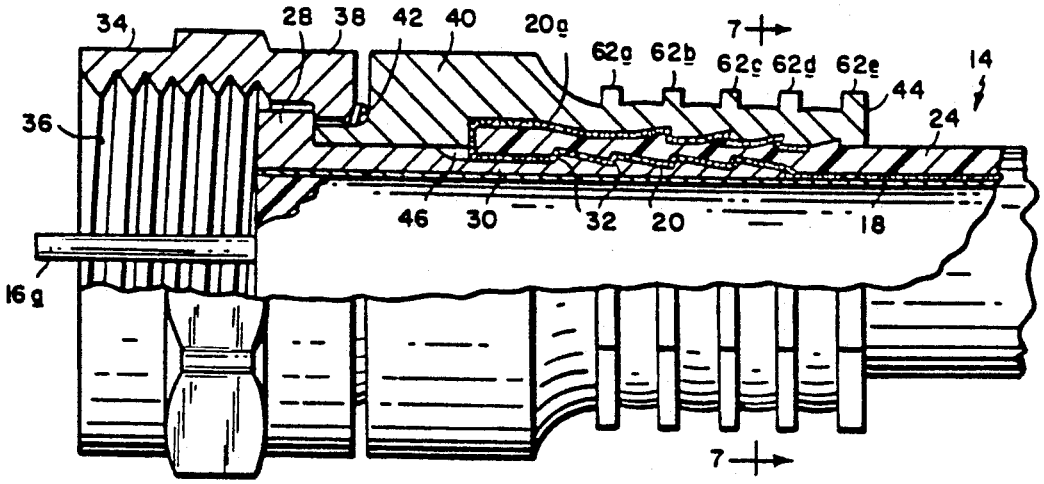
FIG.6

COAXIAL CABLE END CONNECTOR

This is a divisional application of application Ser. No. 364,303, filed June 12, 1989 U.S. Pat. No. 4,990,106 issued Feb. 5, 1991.

BACKGROUND OF THE INVENTION

1. Field of the Invention

This invention relates to end connectors used to connect cables to equipment ports, terminals or the like. The invention is particularly useful in, although not limited to, end connectors for coaxial cables in the cable television industry.

2. Description of the Prior Art

The conventional coaxial cable usually consists of a centrally located inner electrical conductor surrounded by and spaced inwardly from an outer electrical conductor. A dielectric insulator is interposed between the inner and outer conductors, with the outer conductor being surrounded by a protective dielectric jacket. The outer conductor can comprise a sheath of fine braided metallic strands, a metallic foil, or multiple layer combinations of either or both.

The conventional end connector is generally tubular in configuration, with a front end carrying an appropriate fastener designed to mate with equipment ports or terminals, and with a rear end having inner and outer radially spaced open ended concentric sleeves. The inner sleeve is designed to be inserted into a cable end in electrical contact with the outer conductor and electrically isolated from the inner conductor by means of the dielectric insulator. The outer sleeve is then crimped to securely couple the connector to the cable end and to achieve an electrical ground connection and weather seal.

In the past, in order to achieve a secure coupling of the connector to the cable end as well as a weather tight seal therebetween, it has been considered essential to carefully size the outer connector sleeve to the particular cable size. In a system employing a wide range of cable sizes, this can present serious inventory control problems. More importantly, however, the mistaken use of an improperly sized connector can produce a faulty connection, either because the outer sleeve is too small, causing the cable end to be damaged during crimping, or because the outer sleeve is too large, resulting in inadequate coupling and/or sealing. In all of these cases, the resulting faulty connection is likely to be the source of costly and disruptive maintenance problems.

Prior attempts at connector standardization have been largely ineffectual, with the result that the above-described problems have continued to plague the industry.

The principal objective of the present invention is the provision of an improved end connector designed to accommodate a wide range of cable sizes in a manner which insures a reliable electrical connection, a secure mechanical coupling, and a weather tight seal.

SUMMARY OF THE INVENTION

An end connector in accordance with the present invention has an internal tubular post with front and rear ends, the rear end being defined by an open ended cylindrical first sleeve. A fastener on the front end of the post provides a means of attaching the connector to an equipment port or the like. A tubular body is supported on the front end of the post at a location adjacent to the fastener. The tubular body has a rearwardly extending cylindrical open ended second sleeve surrounding the first sleeve and defining an annular chamber therebetween. The second sleeve has a grooved interior surface defining a plurality of circular serrations and a grooved exterior surface defining a plurality of axially spaced circular ribs.

The first sleeve is adapted for insertion into an end of the cable in electrical contact with the outer conductor and electrically isolated from the inner conductor by the dielectric insulator. The protective dielectric cable jacket and an externally folded portion of the outer conductor are received in the annular chamber defined by the first and second connector sleeves. The ribs on the outer surface of the second sleeve are deformable into a hexagonal configuration, with an accompanying inward radial deformation of the circular serrations on the inner surface of the second sleeve towards the first sleeve and into an indented mechanical engagement with the cable jacket and/or the externally folded portion of the outer conductor.

Preferably, the grooved interior surface of the second sleeve tapers outwardly to a maximum internal diameter at its open rear end. Advantageously, the diameters of the ribs on the external surface of the second sleeve are non-uniform, with the largest diameter ribs being located at the rear of the second sleeve.

In order to achieve optimum inward radial deformation of the circular serrations on the inner surface of the second sleeve, the circular ribs on its external surface are preferably provided with diameters which are greater than f/0.866 where "f" is the distance between any two opposed flats of the hexagonal configuration imparted to the ribs during crimping.

Preferably, the exterior surface of the first sleeve is also grooved to provide a series of circular serrations which are surrounded by at least some of the circular serrations on the interior surface of the second sleeve.

BRIEF DESCRIPTION OF THE DRAWINGS

FIG. 4 is an enlarged sectional view showing a portion of the outer second connector sleeve prior to its being crimped onto the end of the coaxial cable;

FIG. 5 is a diagrammatic illustration showing the relationship between the original diameter of the external circular ribs on the second connector sleeve and their ultimate crimped hexagonal configuration;

FIG. 6 is a side elevational view with portions broken away showing the end connector after it has been inserted onto the end of the cable and crimped in place;

DESCRIPTION OF PREFERRED EMBODIMENT

Figure 1:
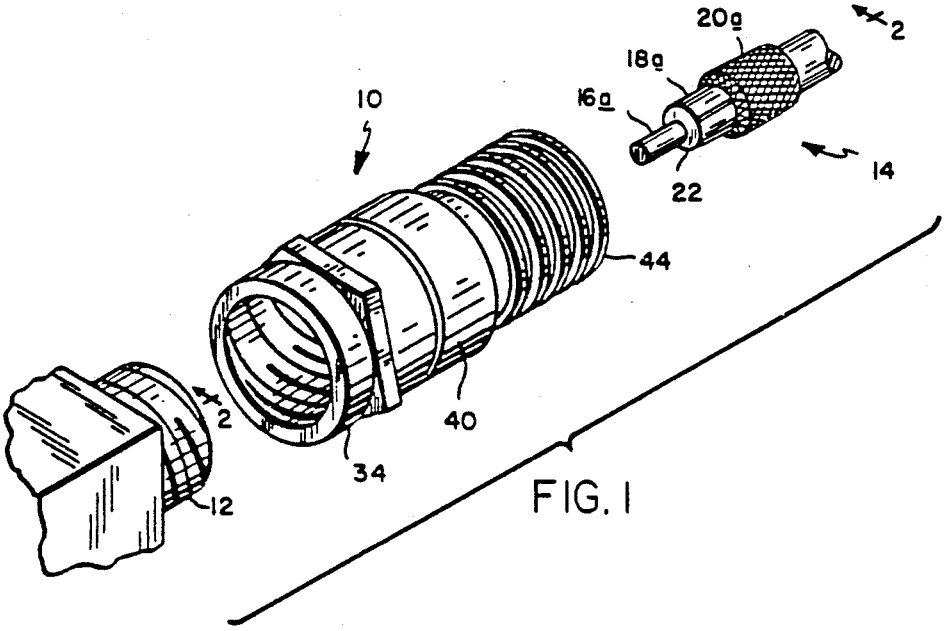
FIG. 1 is an exploded perspective view showing a typical equipment port, an end connector in accordance with the present invention, and an end of a typical coaxial cable which has been prepared for insertion into the end connector.
Figure 2:
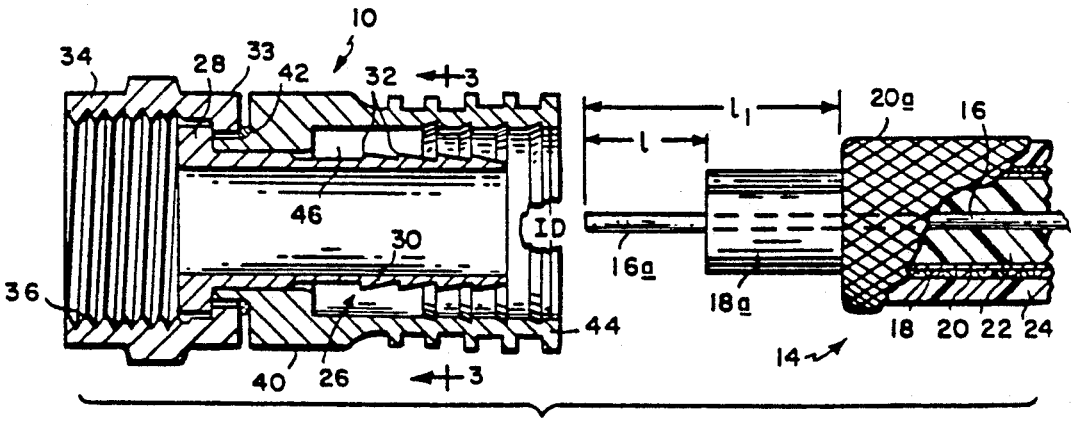
FIG. 2 is a sectional view on an enlarged scale taken along line 2—2 of FIG. 1.
Figure 3:
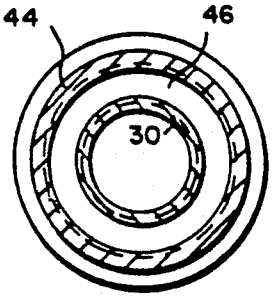
FIG. 3 is a sectional view taken along line 3—3 of FIG. 2.

With reference initially to FIGS. 1-3, an end connector in accordance with the present invention is shown at 10 between a typical externally threaded equipment port 12 and an end of a conventional coaxial cable 14 which has been prepared to receive the end connector.

In the example herein selected for illustrative purposes, the cable 14 includes an electrical inner conductor 16 surrounded by and spaced inwardly from an electrical outer conductor comprising a layer of metallic foil 18 directly underlying a layer of braided metallic mesh 20. The inner and outer conductors are electrically isolated one from the other by a dielectric insulator 22 interposed therebetween. A dielectric protective covering or jacket 24 surrounds the outer conductor.

The end of the cable is prepared for coupling with the end connector by first removing a length $l_1$ of the jacket 24 to thereby expose an end segment 20*a* of the braided metallic mesh. The exposed end segment of mesh is then folded back over the jacket as illustrated in the drawings, thus exposing an end segment 18*a* of the metallic foil. Thereafter, a shorter length $l_2$ of the exposed metallic foil segment 18*a* and the underlying dielectric insulator 22 are removed to thereby expose an end segment 16*a* of the inner conductor.

The end connector 10 of the present invention comprises an inner tubular post 26 having a first flange 28 at a front end thereof and a cylindrical first sleeve 30 at a rear end thereof. The first sleeve is externally grooved to define a series of circular first serrations indicated typically at 32.

A fastener 34 is rotatably received on the front end of the post 26. The fastener is internally threaded as at 36, and is provided with a second flange 38 arranged to coact in mechanical interengagement with the first flange 28 on the post 26.

A tubular body 40 is supported on the front end of the post 26 at a location adjacent to the first flange 28. An O-ring seal 42 is interposed between the tubular body 40 and the fastener 34, and a cylindrical second sleeve 44 extends rearwardly from the tubular body 40. The second sleeve 44 surrounds and is spaced radially from the first sleeve 30 of the post 28 to thereby define an annular chamber 46 therebetween. The second sleeve 44 has an open rear end leading to the annular chamber 46.

Referring additionally to FIG. 4, it will be seen that the interior surface of the second sleeve 44 is provided with a series of grooves 48 spaced one from the other by truncated conical intermediate surfaces 50. The intermediate surfaces 50 lie on a common conical reference plane $P_1$ tapering outwardly towards the rear end of the second sleeve.

The grooves 48 are each defined by leading and trailing conical surfaces 52,54 extending radially outwardly from their respective adjacent intermediate surfaces 50 to converge at the groove bottoms 56. Circular serrations 58 are defined at the junctures of the trailing surfaces 54 and their adjacent intermediate surfaces 50. Thus, the second sleeve 44 has an interior surface tapering outwardly to a maximum internal diameter "ID" at its open rear end (see FIG. 2), with grooves 48 defining a plurality of axially spaced serrations 58.

The exterior surface of the second sleeve 44 is grooved as at 60 to define a plurality of axially spaced ribs 62*a*–62*e*. The innermost rib 62*a* has an outer diameter $OD_1$, the next rib 62*b* has a larger outer diameter $OD_2$, and the last three outermost ribs 62*c*, 62*d* and 62*e* located at the rear end of the second sleeve have a still larger diameter $OD_3$.

The application of the end connector 10 to the prepared end of the cable 14 will now be described with additional reference to FIGS. 5-9. The prepared end of the cable is axially inserted into the open rear end of the connector, bringing the front end of the exposed segment 18*a* of the foil flush with the front end of the post 26, and allowing the exposed segment 16*a* of the inner conductor to protrude slightly beyond the threaded front end of the fastener 34. This axial insertion is accompanied by an insertion of the first sleeve 30 between the foil 18 and the braided metallic mesh 20. The outer dielectric jacket 24 and the folded over segment 20*a* of the mesh are received between first and second sleeves 30, 44 in the annular chamber 46 defined therebetween.

Figure 9:
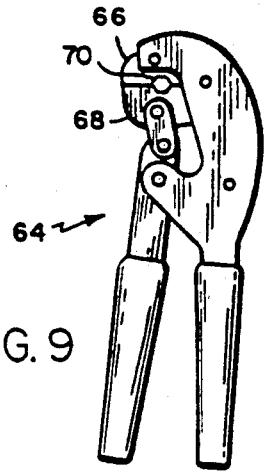
FIG. 9 is an illustration cf a crimping tool used to crimp the end connector of the present invention.

A standard tool of the type illustrated at 64 in FIG. 9 is then employed to crimp the second sleeve 44. The tool has cooperating pivotal jaws 66,68 which are appropriately notched to define a hexagonal opening 70 when in the closed position.

Figure 7:
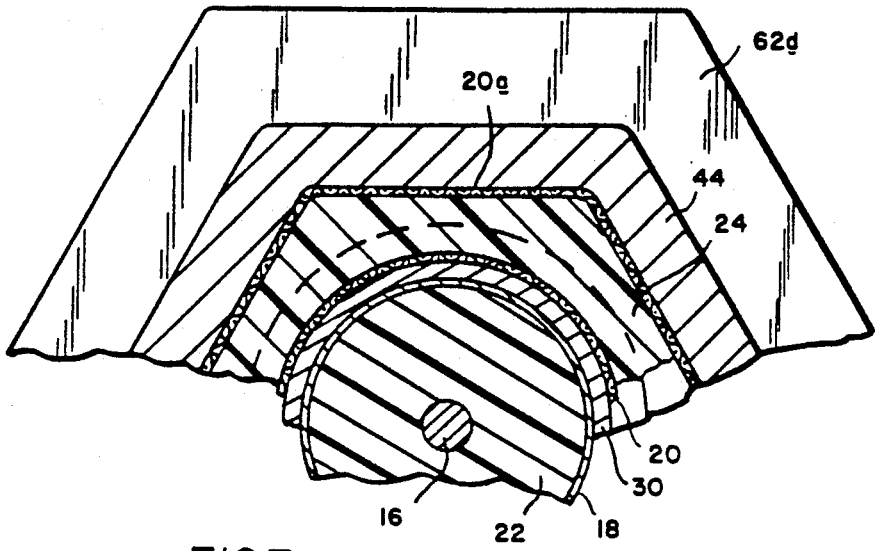
FIG. 7 is a partial sectional view on an enlarged scale taken along lines 7—7 of FIG. 6.

During the crimping operation, the jaws 66,68 impart a hexagonal configuration to the ribs 62*a*–62*e*, as partially illustrated in FIG. 7.

With reference to FIG. 5, those skilled in the art will appreciate that the development of a hexagonal cross sectional configuration from a round is governed by the formula $$D = \frac{f}{.866}$$

where:

F = distance across opposed flats of the hexagonal configuration

D = diameter of round.

The typical conventional crimping tool 64 has an "f" dimension of 0.0360" and in accordance with the foregoing formula, is used to crimp rounds having a diameter D of 0.4157".

Figure 8:
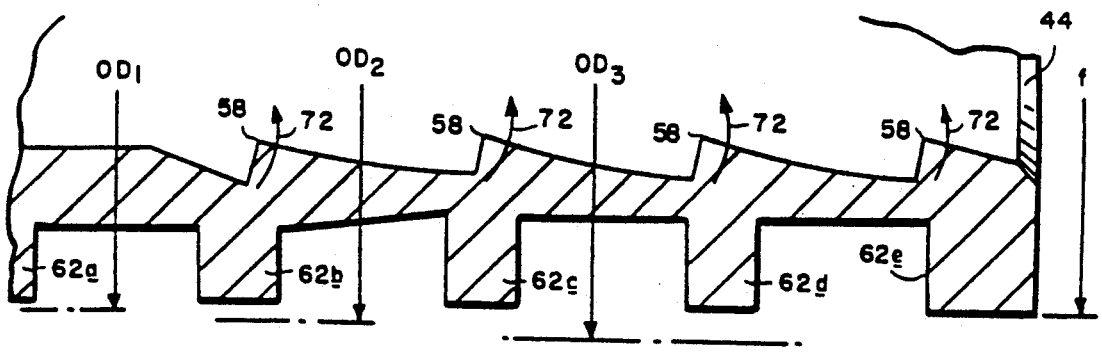
FIG. 8 is a view similar to FIG. 4 showing the internal circular serrations on the second sleeve after they have been crimped into an indented relationship with the end of the cable.

The present invention departs from conventional practice by providing the circular ribs 62*a*–62*e* with external diameters $OD_1$, $OD_2$ and $OD_3$ which are larger than f/0.866. During the crimping operation, as illustrated in FIG. 8, the ribs 62*a*–62*e* are compressed radially inwardly. Most of the rib material flows into and fills the hexagonal configuration defined by the notched jaws 66,68 of the crimping tool. Thus, the diameters $OD_1$, $OD_2$ and $OD_3$ are reduced to the flat sided dimension "f". The excess rib material flows radially inwardly, causing the serrations 58 to twist inwardly as indicated by the arrows 72 and to bite into the cable jacket 24 and the folded over braided mesh segment 20*a*.

As a result of this crimping operation, and as can best be seen in FIGS. 6 and 7, the cable jacket 24 and folded over braided mesh segment 20*a* are gripped between the serrations 58 on the second sleeve 44 and the serrations 32 on the first sleeve 30, thus establishing a positive and reliable interlock. The jacket material flows into and fills the inner and outer confronting grooves of the sleeves 30, 44, completely filling the annular chamber 46 and thus creating a weather tight seal.

In light of the foregoing, it will now be appreciated by those skilled in the art that the end connector of the present invention embodies a number of advantageous features. For example, the outwardly tapering inner surface of the second sleeve 44 to a maximum internal diameter at the open rear end enables the end connector to accommodate a range of cable sizes. The configuration of the second serrations 58 and their relationship to the purposely oversized external circular ribs 62*a*–62*e* results in a unique crimping action, with the serrations 58 twisting inwardly to bite into the cable jacket and externally folded braided mesh segment 28. The serrations 58 coact with the serrations 32 on the first sleeve 30 to securely grip the cable therebetween without squashing or otherwise damaging the cable. The dielectric insulator 22 and the metallic foil 18 remain round, even after crimping, which is of importance in maintaining proper impedance for the normal cable. The material of the cable jacket flows into and effectively fills the grooved confronting surfaces of the first and second sleeves 30,44 to provide an effective weather tight seal.

I claim:

1. An end connector for connecting a coaxial cable to a port, said cable being of the type having an electrical inner conductor surrounded by and spaced inwardly from an electrical outer conductor, with a dielectric insulator interposed between said inner and outer conductors, and with a dielectric jacket surrounding the outer conductor, said end connector comprising:

a tubular post having a front end and a rear end, with a cylindrical first sleeve opening towards said rear end;

fastener means at the front end of said post for attaching said connector to said port; and a tubular body supported at the front end of said post at a location adjacent to said fastener means, said body having a cylindrical second sleeve surrounding and spaced radially from said first sleeve to define an annular chamber therebetween, said second sleeve having an open rear end leading to said annular chamber, said second sleeve having an interior surface and having grooves in its exterior surface defining a plurality of axially spaced circular ribs, with the rearmost of said ribs located at the rearmost extremity of said tubular body and surrounding said open end, said first sleeve being adapted for insertion into a position in an end of said cable at which said second sleeve is in electrical contact with said outer conductor and electrically isolated from said inner conductor by said dielectric insulator, with said jacket being received in said chamber and being surrounded by said second sleeve, at least some of said ribs including said rearmost rib being deformable into hexagonal configurations and having diameters greater than f/0.866 where "f" is the distance between any two opposed flats of said hexagonal configuration, the deformation of said ribs into said hexagonal configurations causing said interior surface to be deformed inwardly into indented mechanical engagement with said jacket at said rearmost extremity to sealingly engage said jacket as well as at other locations which are spaced axially along the length of that portion of said jacket received in said chamber.

2. The end connector of claim 1 wherein said interior surface tapers outwardly to a maximum internal diameter at the open rear end of said second sleeve.

3. The end connector of claim 1 wherein the diameters of said ribs are non-uniform, with the largest diameter ribs being located at the rear end of said second sleeve.

4. An end connector for connecting a coaxial cable to a port, said cable being of the type having a electrical inner conductor surrounded by and spaced inwardly from an electrical outer conductor, with a dielectric insulator interposed between said inner and outer conductors, and with a dielectric jacket surrounding the outer conductor, said end connector comprising:

a tubular post having a front end and a rear end, with a cylindrical first sleeve opening towards said rear end;

fastener means at the front end of said post for attaching said connector to said port; and a tubular body supported at the front end of said post at a location adjacent to said fastener means, said body having a cylindrical second sleeve surrounding and spaced radially from said first sleeve to define an annular chamber therebetween, said second sleeve having an interior surface tapering outwardly to a maximum internal diameter at an open rear end leading to said annular chamber, and having grooves in its exterior surface defining a plurality of axially spaced circular ribs, said first sleeve being adapted for insertion into a position in an end of said cable at which said second sleeve is in electrical contact with said outer conductor and electrically isolated from said inner conductor by said dielectric insulator, with said jacket being received in said chamber and being surrounded by said second sleeve, said ribs being deformable into a hexagonal configuration with an accompanying inward deformation of said interior surface towards said first sleeve and into indented mechanical engagement with said jacket.

5. The end connector of claim 4 wherein the outer diameters of said circular ribs are non-uniform, with the smallest diameter ribs being located at the front end of said second sleeve, and with the largest diameter ribs being located at the rear end of said second sleeve.

6. The end connector of either claims 4 or 5 wherein the outer diameters of at least some of said circular ribs is greater than f/0.866 where "f" is the distance between any two opposed flats of said hexagonal configuration.

7. An end connector for connecting a coaxial cable to a port, said cable being of the type having an electrical inner conductor surrounded by and spaced inwardly from an electrical outer conductor, with a dielectric insulator interposed between said inner and outer conductors, and with a dielectric jacket surrounding the outer conductor, said end connector comprising:

a tubular post having a front end and a rear end, with a cylindrical first sleeve opening towards said rear end;

fastener means at the front end of said post for attaching said connector to said port; and a tubular body supported at the front end of said post at a location adjacent to said fastener means, said body having a cylindrical second sleeve surrounding and spaced radially from said first sleeve to define an annular chamber therebetween, said second sleeve having an open rear end leading to said annular chamber and having grooves in its exterior surface defining a plurality of axially spaced circular ribs, the outer diameters of said ribs being non-uniform, with the smallest diameter ribs being located at the front end of said second sleeve, and with the largest diameter ribs being located at the rear end of said second sleeve, said first sleeve being adapted for insertion into a position in an end of said cable at which said second sleeve is in electrical contact with said outer conductor and electrically isolated from said inner conductor by said dielectric insulator, with said jacket being received in said chamber and being surrounded by said second sleeve, said ribs being deformable into a hexagonal configuration with an accompanying inward deformation of said second sleeve towards said first sleeve and into indented mechanical engagement with said jacket.

8. An end connector for connecting a coaxial cable to a port, said end connector comprising:

a tubular post having a front end and a rear end, with a cylindrical first sleeve opening towards said rear end;

fastener means at the front end of said post for attaching said connector to said port; and a tubular body supported at the front end of said post at a location adjacent to said fastener means, said body having a cylindrical second sleeve surrounding and spaced radially from said first sleeve to define an annular chamber therebetween, said second sleeve having an interior surface tapering outwardly to a maximum internal diameter at an open rear end leading to said annular chamber, and having grooves in its exterior surface defining a plurality of axially spaced circular ribs, said first sleeve being adapted for insertion into an end of said cable with the said end of said cable being received in said chamber and being surrounded by said second sleeve, said ribs being deformable into a hexagonal configuration with an accompanying inward deformation of said interior surface towards said first sleeve and into indented mechanical engagement with the exterior of said cable.

9. The end connector of claim 8 wherein the outer diameters of said circular ribs are non-uniform, with the smallest diameter ribs being located at the front end of said second sleeve, and with the largest diameter ribs being located at the rear end of said second sleeve.

10. The end connector of either claims 8 or 9 wherein the outer diameter of at least some of said circular ribs is greater than f/0.866 where "f" is the distance between any two opposed flats of said hexagonal configuration.

11. The end connector of claim 1 wherein said inner surface is grooved to define a plurality of circular serrations.

12. The end connector of claim 11 wherein the exterior surface of said first sleeve is grooved to provide a series of circular serrations surrounded by at least some of the circular serrations in the interior surface of said second sleeve.

13. The end connector of claim 11 wherein the grooves in the interior surface of said second sleeve are each located axially between truncated conical intermediate surfaces lying on a common conical reference cone tapering outwardly towards the rear end of said second sleeve.

14. The end connector of claim 13 wherein said grooves are each defined by leading and trailing surfaces extending radially outwardly from their respective intermediate surfaces to converge at the bottoms of said grooves, with said serrations being formed at the juncture between said trailing surfaces and their respective intermediate surfaces.

* * * * *

US005073129A

REEXAMINATION CERTIFICATE (2213th)

United States Patent [19]

Szegda

[11] B1 5,073,129

[45] Certificate Issued Feb. 8, 1994

[54] COAXIAL CABLE END CONNECTOR

[75] Inventor: Andrew Szegda, Canastota, N.Y.

[73] Assignee: John Mezzalingua Assoc. Inc., Manlius, N.Y.

Reexamination Request:
No. 90/002,961, Feb. 11, 1993

Reexamination Certificate for:

| | |
|---|---|
| Patent No.: | **5,073,129** |
| Issued: | **Dec. 17, 1991** |
| Appl. No.: | **647,837** |
| Filed: | **Jan. 30, 1991** |

Related U.S. Application Data

[62] Division of Ser. No. 364,303, Jun. 12, 1989, Pat. No. 4,490,106.

[51] Int. Cl.[5] ..... H01R 17/04

[52] U.S. Cl. ..... 439/585; 439/882; 439/578

[58] Field of Search ..... 439/578–585, 439/675, 877–879

[56] References Cited

U.S. PATENT DOCUMENTS

| | | |
|---|---|---|
| 2,375,480 | 5/1945 | Lee . |
| 2,375,741 | 5/1945 | Dibner . |
| 3,196,382 | 7/1965 | Morello, Jr. . |
| 3,212,050 | 10/1965 | Stark . |
| 3,362,632 | 1/1968 | Scurr et al. . |
| 3,428,739 | 2/1969 | Jackson . |
| 3,510,829 | 5/1970 | Keller . |
| 3,845,454 | 10/1974 | Hayward et al. . |
| 3,847,463 | 11/1974 | Hayward et al. . |
| 4,145,729 | 3/1979 | Hayward . |
| 4,345,375 | 8/1982 | Hayward . |
| 4,355,857 | 10/1982 | Hayward . |
| 4,469,390 | 9/1984 | LeVine et al. . |
| 4,575,274 | 3/1986 | Hayward . |
| 4,681,390 | 7/1987 | Hayward . |
| 4,797,121 | 1/1989 | Hayward . |
| 4,925,403 | 5/1990 | Zorzy . |
| 5,055,060 | 10/1992 | Down et al. . |

FOREIGN PATENT DOCUMENTS

| | | |
|---|---|---|
| 0020188A2 | 12/1980 | European Pat. Off. . |
| 0135371A1 | 3/1985 | European Pat. Off. . |
| 165154A | 12/1985 | European Pat. Off. . |
| 0217653A2 | 4/1987 | European Pat. Off. . |
| 0265276A2 | 4/1988 | European Pat. Off. . |
| 0351903A1 | 1/1990 | European Pat. Off. . |
| 1615551 | 3/1964 | Fed. Rep. of Germany . |
| 1465106 | 9/1964 | Fed. Rep. of Germany . |
| 1465126 | 11/1964 | Fed. Rep. of Germany . |
| 1465137 | 1/1965 | Fed. Rep. of Germany . |
| 1465170 | 12/1968 | Fed. Rep. of Germany . |
| 1805663 | 8/1969 | Fed. Rep. of Germany . |
| 1615555 | 10/1969 | Fed. Rep. of Germany . |
| 3218044C | 3/1982 | Fed. Rep. of Germany . |
| 2331893 | 11/1976 | France . |
| 2420227 | 3/1979 | France . |
| 2478882 | 3/1980 | France . |
| 2524722 | 10/1983 | France . |
| 2574994 | 6/1986 | France . |
| 43-29070 | 12/1968 | Japan . |
| 44-23492 | 10/1969 | Japan . |
| 47-10086 | 10/1972 | Japan . |
| 48-75186 | 9/1973 | Japan . |
| 48-56581 | 10/1973 | Japan . |
| 50-124910 | 9/1975 | Japan . |
| 55-93981 | 6/1980 | Japan . |
| 57-64084 | 10/1980 | Japan . |
| 57-66880 | 4/1982 | Japan . |
| 58-131679 | 8/1983 | Japan . |
| 58-193583 | 12/1983 | Japan . |
| 59-26545 | 8/1984 | Japan . |
| 61-60551 | 12/1986 | Japan . |
| 62-116475 | 7/1987 | Japan . |
| 62-158776 | 10/1987 | Japan . |
| 63-49780 | 4/1988 | Japan . |
| 64-27983 | 1/1989 | Japan . |
| 1-112679 | 5/1989 | Japan . |
| 20140 | of 1914 | United Kingdom . |
| 1186138 | 4/1970 | United Kingdom . |
| 2019665A | 10/1979 | United Kingdom . |
| 2064236A | 1/1981 | United Kingdom . |
| 2154810A | 9/1985 | United Kingdom . |
| 2155704A | 9/1985 | United Kingdom . |

OTHER PUBLICATIONS

1982 PPC Connector Catalog.

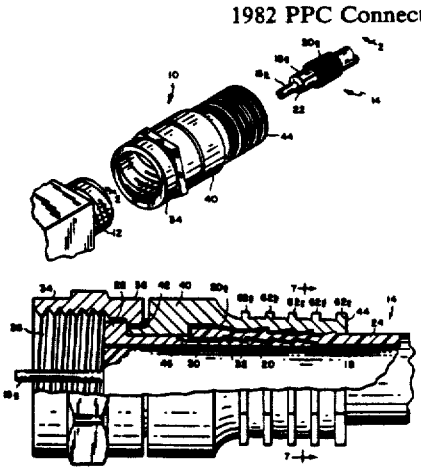

1987 PPC Connector Catalog.
SIR Publication No. 1066560, Feb. 23, 1966.
SIR Publication No. 1134565, Jan. 19, 1967.
SIR Publication No. 1331507, Nov. 16, 1970.
SIR Publication No. 1363133, Jul. 26, 1971.
SIR Publication No. 1473676, May 28, 1974.
SIR Publication No. 1590319, Dec. 20, 1977.
Gilbert Engineering, "OEM Coaxial Connectors" catalog, 1985/1986, PY-3064-PY 3131.
Gilbert Engineering, 1987/1988 catalog, PY-3133-PY 3211.
Pyramid Industries, "F-59-ALM w/Zinc Chromate Assembly", F-59-ALM-I-O, Nov. 12, 1984, pp. PY-4700-PY-4703.
Pyramid Industries, "F-59 ALM", F-59-ALM-000, Aug. 26, 1983, PY-154 (4 pages).
Pyramid Industries, "F-59-ALM-Nut Ret", Jan. 24, 1978, PY-153 (5 pages).
Pyramid Industries, "F-56-ALS-357 Assembly", F-5-6-ALS-357, Apr. 19, 1983, PY-156 (4 pages).
Pyramid Industries, "F-56-ALS Assembly", F-5-6-ALS-000, Apr. 19, 1983, PY-155 (4 pages).
Pyramid Industries, "F-56-ALS-357 Assembly", Apr. 19, 1983, PY-132 (9 pages).
Pyramid Industries, "F-56-ALS-Connector", Sep. 23, 1981, PY-131 (9 pages).
PPC Connector Catalogue, "Maximum Shield F-Connector", Products Production Co., 1982, pp. 17-18.
PPC Connector Catalogue, vol. 253, "Maximum Shield F-Connectors", Products Production Co., 1987 p. 26.

*Primary Examiner*—David Pirlot

[57] ABSTRACT

An end connector is disclosed for cables, particularly coaxial cables of the type employed in the cable television industry. The crimping sleeve of the connector has external ribs and internal serrations designed to accommodate a wide range of cable sizes in a manner which insures a reliable electrical connection, a secure mechanical coupling, and a weather tight seal.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 4–6 and 8–10 is confirmed.

Claims 1 and 7 are determined to be patentable as amended.

Claims 2, 3, 11–13 and 14 dependent on an amended claim, are determined to be patentable.

1. [An end connector for connecting a coaxial cable to a port,] *For use in combination with a plurality of differently sized coaxial cables, each of* said [cable] *cables* being of the type having an electrical inner conductor surrounded by and spaced inwardly from an electrical outer conductor, with a dielectric insulator interposed between said inner and outer conductors, and with a dielectric jacket surrounding the outer conductor, *an end connector for connecting said plurality of differently sized cables to a port,* said end connector comprising:

a tubular post having a front end and a rear end, with a cylindrical first sleeve opening towards said rear end;

fastener means at the front end of said post for attaching said connector to said port; and a tubular body supported at the front end of said post at a location adjacent to said fastener means, said body having a cylindrical second sleeve surrounding and spaced radially from said first sleeve to define an annular chamber therebetween, said second sleeve having an open rear end leading to said annular chamber, said second sleeve having an interior surface and having grooves in its exterior surface defining a plurality of axially spaced circular ribs, with the rearmost of said ribs located at the rearmost extremity of said tubular body and surrounding said open end, said first sleeve being adapted for insertion into *respective ends of said plurality of differently sized cables in* a position [in an end of said cable] at which said second sleeve is in electrical contact with [said] *the* outer [conductor] *conductors* and electrically isolated from [said] *the* inner [conductor] *conductors* by [said] *the* dielectric *insulators at said respective ends, with the jackets at said respective ends* [insulator, with said jacket] being received in said chamber and being surrounded by said second sleeve, at least some of said ribs including said rearmost rib being deformable into *a* hexagonal [configurations] *configuration* and having diameters greater than f/0.866 where "f" is the distance between any two opposed flats of said hexagonal configuration, the *dimensions by which the diameters of said ribs exceed f/0.866 being such that upon* deformation of said ribs into hexagonal [configurations causes] *configuration,* said interior surface [to] *will* be deformed inwardly into indented mechanical engagement with *the jackets of said plurality of differently sized cables* [said jacket] at said rearmost extremity [to sealingly engage said jacket] as well as at other locations which are spaced axially along the length of [that] *those* [portion] *portions* of said [jacket] *jackets* received in said chamber, *the said indented mechanical engagement being effective to sealingly engage said jackets at said rearmost extremity and to coact with said first sleeve in deforming said jackets to an extent sufficient to produce a reliable electrical connection and secure mechanical coupling of said connector to said cables while also achieving a weather tight seal between said cables and said end connector.*

7. [An end connector for connecting a coaxial cable to a port,] *For use in combination with a plurality of differently sized coaxial cables, each of* said [cable] *cables* being of the type having an electrical inner conductor surrounded by and spaced inwardly from an electrical outer conductor, with a dielectric insulator interposed between said inner and outer conductors, and with a dielectric jacket surrounding the outer conductor, *an end connector for connecting said plurality of differently sized cables to a port,* said end connector comprising:

a tubular post having a front end and a rear end, with a cylindrical first sleeve opening towards said rear end;

fastener means at the front end of said post for attaching said connector to said port; and a tubular body supported at the front end of said post at a location adjacent to said fastener means, said body having a cylindrical second sleeve surrounding and spaced radially from said first sleeve to define an annular chamber therebetween, said second sleeve having an open rear end leading to said annular chamber and having grooves in its exterior surface defining a plurality of axially spaced circular ribs, the outer diameters of said ribs being nonuniform, with the smallest diameter ribs being located at the front end of said second sleeve, and with the largest diameter ribs being located at the rear end of said second sleeve;

said first sleeve being adapted for insertion into *respective ends of said plurality of differently sized cables in* a position [in an end of said cable] at which said second sleeve is in electrical contact with [said] *the* outer [conductor] *conductors* and electrically isolated from [said] *the* inner [conductor] *conductors* by [said dielectric insulator, with said jacket] *the dielectric insulators at said respective ends, with the jackets at said respective ends* being received in said chamber and being surrounded by said second sleeve;

said ribs being deformable into a hexagonal configuration with an accompanying inward deformation of said second sleeve towards said first sleeve and into indented mechanical engagement with said [jacket] *jackets, said ribs having diameters greater than f/0.866 where "f" is the distance between any two opposed flats of said hexagonal configuration, the dimensions by which the diameters of said ribs exceed f/0.866 being such that the inward deformation of said second sleeve coacts with the said first sleeve to deform said jackets to an extent sufficient to produce a reliable electrical connection and secure mechanical coupling of said connector to said plurality of differently sized cables while also achieving a weather tight seal between said cables and said end connector.*

* * * * *